US009181017B2

(12) United States Patent
Bae et al.

(10) Patent No.: US 9,181,017 B2
(45) Date of Patent: Nov. 10, 2015

(54) TABLET CARTRIDGE FOR MEDICATION DISPENSING APPARATUS

(71) Applicant: Infopia Co., Ltd., Anyang-si (KR)

(72) Inventors: Byeong-Woo Bae, Anyang-si (KR); Keun-Young Kim, Seoul (KR)

(73) Assignee: Infopia Co., Ltd., Anyang-si (KR)

( * ) Notice: Subject to any disclaimer, the term of this patent is extended or adjusted under 35 U.S.C. 154(b) by 113 days.

(21) Appl. No.: 13/948,597

(22) Filed: Jul. 23, 2013

(65) Prior Publication Data

US 2014/0183208 A1 Jul. 3, 2014

(30) Foreign Application Priority Data

Jan. 2, 2013 (KR) ..... 10-2013-0000309

(51) Int. Cl.

*B65D 83/04* (2006.01)
*A61J 7/00* (2006.01)
*G07F 17/00* (2006.01)

(52) U.S. Cl.

CPC ..... *B65D 83/04* (2013.01); *A61J 7/0084* (2013.01); *G07F 17/0092* (2013.01)

(58) Field of Classification Search

CPC . G07F 17/0092; B65D 83/04; B65D 83/0409
USPC ..... 221/241, 304
See application file for complete search history.

(56) References Cited

U.S. PATENT DOCUMENTS 6,497,342 B2 * 12/2002 Zhang et al. ..... 221/265
6,974,052 B1 12/2005 d'Hond et al.
7,014,071 B1 3/2006 d'Hond et al.
7,669,733 B2 * 3/2010 Kim ..... 221/265
7,747,345 B2 * 6/2010 Ohmura et al. ..... 700/231
8,887,603 B2 * 11/2014 Yuyama et al. ..... 221/265
2007/0150092 A1 6/2007 Ohmura et al.
2008/0099499 A1 5/2008 Kim
2013/0062363 A1 3/2013 Yuyama et al.
2014/0084020 A1 3/2014 Yoshinori

FOREIGN PATENT DOCUMENTS

CN 1370271 A 9/2002
EP 0 761 197 A1 3/1997
JP 2002-153541 A 5/2002
JP 2002-272812 A 9/2002

(Continued)

OTHER PUBLICATIONS

European Search Report mailed Dec. 18, 2014 in counterpart European Application No. 13176104.1 (3 pages, in English).

*Primary Examiner* — Timothy Waggoner
(74) *Attorney, Agent, or Firm* — NSIP Law

(57) ABSTRACT

A tablet cartridge includes a rotor, a tablet stopper, a case, and a stopper cover. The rotor has a plurality of guide-teeth protruding at regular intervals along a circumference of the rotor, and has tablet insertion grooves formed between the guide-teeth. The tablet stopper is disposed to close a top of one of the tablet insertion grooves. The case includes a dispensing opening formed at a position on a lower portion of the rotor housing portion, corresponding to a position of the tablet stopper, and a stopper insertion hole of a length that allows for the tablet stopper to adjust its height while being inserted into the stopper insertion hole. The stopper cover is coupled to the case to close the stopper insertion hole, and has the tablet stopper mounted thereon at an adjusted height.

4 Claims, 7 Drawing Sheets

(56) References Cited

FOREIGN PATENT DOCUMENTS

| | | | |
|---|---|---|---|
| JP | 2005-247355 | A | 9/2005 |
| JP | 2011-45700 | A | 3/2011 |
| KR | 10-0716751 | B1 | 5/2007 |
| KR | 20-0438560 | | 2/2008 |
| KR | 10-2013-0079397 | A | 7/2013 |
| WO | WO 2011/145471 | A1 | 11/2011 |
| WO | WO 2012/105286 | A1 | 8/2012 |

* cited by examiner

TABLET CARTRIDGE FOR MEDICATION DISPENSING APPARATUS

CROSS REFERENCE TO RELATED APPLICATIONS

This application claims priority from and the benefit of Korean Patent Application No. 10-2013-0000309, filed on Jan. 2, 2013, the disclosure of which is incorporated herein in its entirety by reference.

BACKGROUND

1. Field

The following description relates to a tablet cartridge for use in a medication dispensing apparatus to hold tablets or capsules.

2. Background

Recently, many studies on an automated medication dispensing apparatus have been carried out to overcome problems caused by pharmacists' manual dispensing of medications. Generally, a medication dispensing apparatus has a set of tablet cartridges arranged in multiple layers with upper part to contain various types of tablets or capsules held in an upper chamber. The tablets contained in the tablet cartridges may be selectively discharged under the user's control by use of a computer interfaced with the tablet cartridges. The tablets discharged from the cartridges are collected in a hopper and then packaged in a packaging unit located in a lower part of the medication dispensing apparatus.

The tablet cartridge has an opening for dispensing tablets at a lower part of a case, and a cylindrical rotor above the dispensing opening with a plurality of "guide-teeth" and tablet insertion grooves along its circumference. The rotor is connected to a rotator placed under the dispensing opening. The rotor rotates along with the rotator, which is rotated by a rotation motor.

A large number of tablets are contained in the case of the tablet cartridge, and a single tablet or a predetermined number of tablets are stored in each tablet insertion groove between the guide-teeth of the rotor disposed below the case. In this state, as the rotor rotates, the tablet insertion grooves change positions and each is sequentially brought into line with the dispensing opening, such that the tablets in the tablet insertion groove 112 are discharged through the dispensing opening. At this time, a tablet stopper is provided at the top of the dispensing opening. The tablet stopper closes the top of the tablet insertion groove that is placed in line with the dispensing opening, so as to prevent other tablets contained in another tablet insertion groove from being discharged through the dispensing opening.

According to conventional methods, an installation of a tablet stopper in a case is difficult to perform. To address this problem, Korean Utility Model Registration No. 20-0438560 (published on Feb. 22, 2008) discloses a coupling projection unit on one side of a tablet case to allow for the installation of a tablet separation plate, which is equivalent to a tablet stopper. The coupling projection unit includes inserting projections on each side. The tablet case has an insertion hole at a position corresponding to the center of the coupling projection unit. The tablet separation plate with fixing projections is inserted into the insertion hole. A cover having inserting grooves formed on both sides thereof is attached to the coupling projection unit.

If the type of tablets to be contained in the case changes, a rotor needs to be replaced by another one having a width and height suitable for the changed tablets. According to the related art, an insertion hole has to be altered in accordance with the width and height of tablet insertion grooves of the new rotor, so as to allow the tablet separation plate to be inserted through the case, and thus difficulties in efficiently adapting to the rotor replacement occur.

SUMMARY

In one general aspect, there is provided a tablet cartridge for use in a medication dispensing apparatus, the tablet cartridge including: a rotor configured to have a plurality of guide-teeth protruding at regular intervals along a circumference of the rotor, and have tablet insertion grooves formed between the guide-teeth; a tablet stopper disposed to close a top of one of the tablet insertion grooves; a case configured to include a container to accommodate the tablets, a rotor housing portion at a lower part of the container to house the rotor, a dispensing opening formed at a position on a lower portion of the rotor housing portion, corresponding to a position of the tablet stopper, and a stopper insertion hole of a length that allows for the tablet stopper to adjust its height while being inserted into the stopper insertion hole; and a stopper cover coupled to the case to close the stopper insertion hole, and have the tablet stopper mounted thereon at an adjusted height.

Other features will become apparent to those skilled in the art from the following detailed description, which, taken in conjunction with the attached drawings, discloses exemplary embodiments of the invention.

DETAILED DESCRIPTION

The following detailed description is provided to assist the reader in gaining a comprehensive understanding of the methods, apparatuses and/or systems described herein. Accordingly, various changes, modifications, and equivalents of the systems, apparatuses and/or methods described herein will be suggested to those of ordinary skill in the art. Also, descriptions of well-known functions and constructions are omitted to increase clarity and conciseness.

Figure 1:
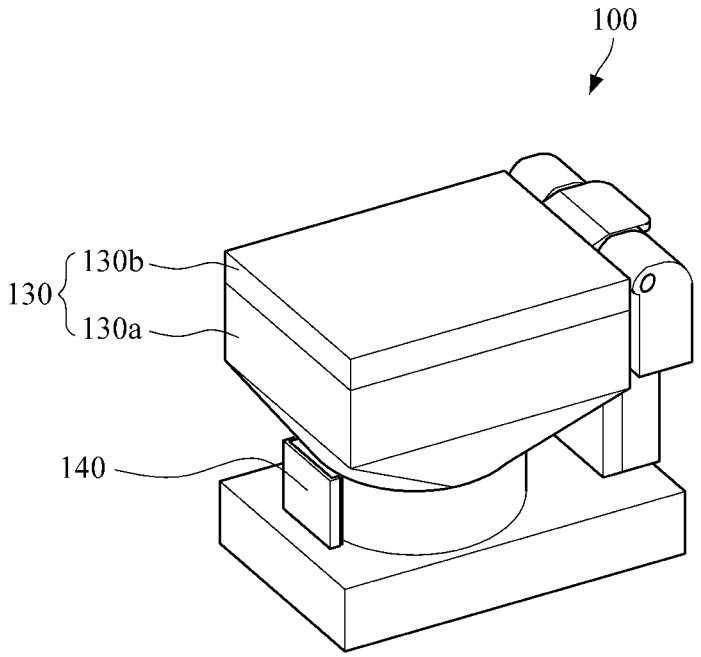
FIG. 1 is a diagram illustrating a perspective view of a tablet cartridge for use in a medication dispensing apparatus.
Figure 2:
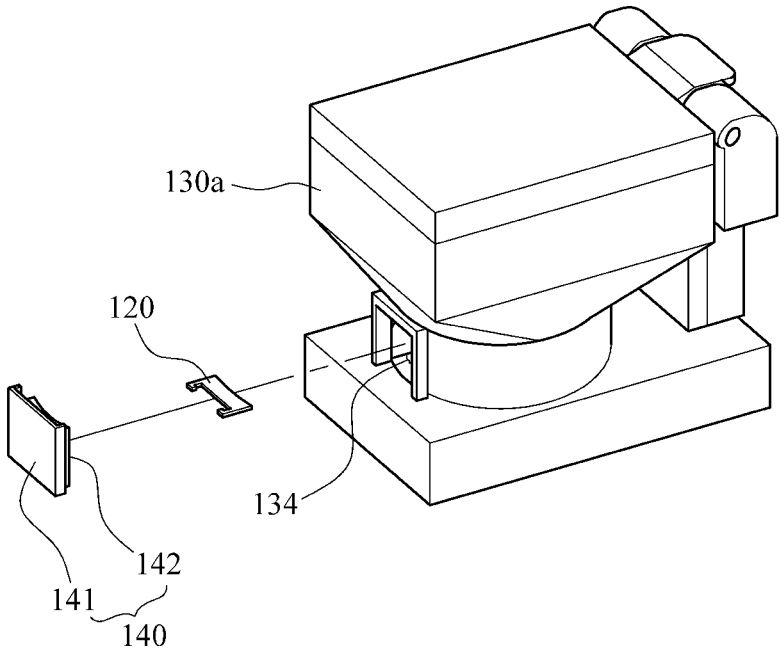
FIG. 2 is a diagram illustrating an exploded perspective view of a stopper cover and tablet stopper separated from the tablet cartridge of FIG. 1.
Figure 3:
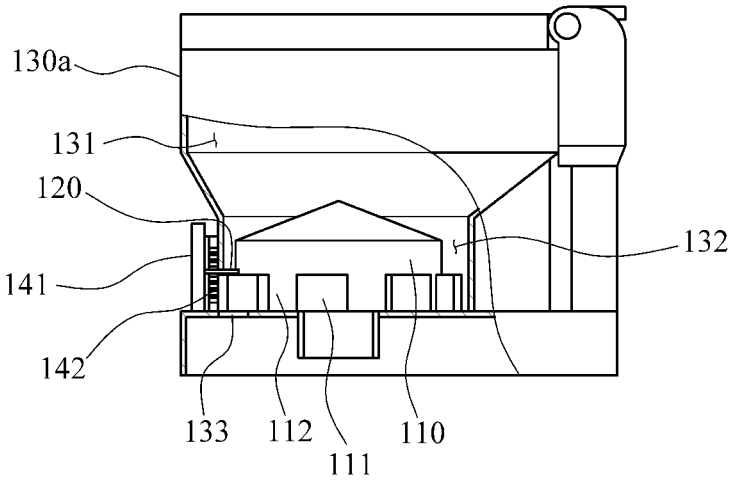
FIG. 3 is a diagram illustrating a frontal cross-sectional view of FIG. 1.
Figure 4:
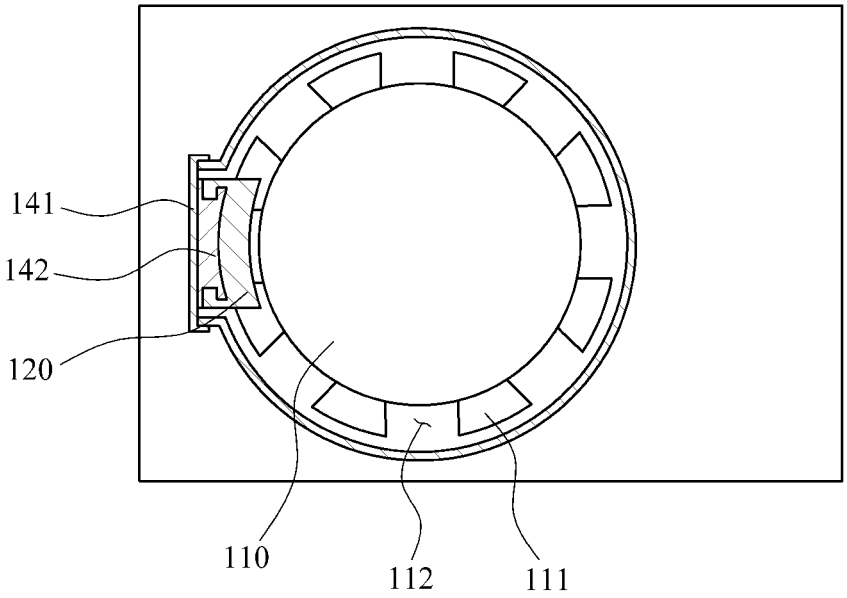
FIG. 4 is a diagram illustrating a top cross-sectional view of FIG. 1.

FIG. 1 is a diagram illustrating a perspective view of a tablet cartridge for use in a medication dispensing apparatus. FIG. 2 is a diagram illustrating an exploded perspective view of a stopper cover and tablet stopper separated from the tablet cartridge of FIG. 1. FIG. 3 is a diagram illustrating a frontal cross-sectional view of FIG. 1. FIG. 4 is a diagram illustrating a top cross-sectional view of FIG. 1.

Referring to FIGS. 1 to 4, the tablet cartridge 100 may be used in a medication dispensing apparatus to contain tablets or capsules, and may include a rotor 110, a tablet stopper 120, a case 130, and a stopper cover 140.

The rotor 110 may have a plurality of guide-teeth 111 protruding at regular intervals along a circumference of the rotor 110, and have tablet insertion grooves 112 formed between the guide-teeth 111. The width and height of each table insertion groove 112 may be determined dynamically to conform to the shape of the tablets or capsules contained in the case 130. When the type of tablets to be contained in the case 130 is changed, the rotor 110 may be replaced by another rotor having tablet insertion grooves with a width and height suitable for the changed tablets. The rotor 110 may be connected with a rotator (not shown) at a lower part thereof. The rotor 110 rotates along with the rotator which is driven by a motor, such as a rotation motor. The rotator and the rotation motor may be provided in a cartridge base mounted on a lower portion of the case 130.

The tablet stopper 120 may be disposed to close a top of any one of the tablet insertion grooves 112. A portion of the tablet stopper 120 that covers the top of the tablet insertion groove 112 may be larger than the top opening of the tablet insertion groove 112. The tablet stopper 120 may be designed to adapt to virtually all widths of the tablet insertion grooves 112, which may vary depending on the types of tablets.

The case 130 may include a container 131 to accommodate the tablets. The case 130 may include a rotor housing portion 132 at a lower part of the container 131 to house the rotor 10. The case 130 may have a dispensing opening 133 formed at a position on a lower portion of the rotor housing portion 132, corresponding to a position of the tablet stopper 120.

The case 130 may include a case body 130*a* and a case cover 130*b*. The case body 130*a* includes the container 131, the rotor housing portion 132, and the dispensing opening 133. The case body 130*a* is configured to have an open top allowing the tablets to be contained therethrough. The case cover 130*b* is hinged to a top edge of the case body 130*a* in such a manner to open and close the open top of the case body 130*a*.

A large number of tablets may be contained in the container 131 of the case 130, and a single tablet or a predetermined number of tablets may be stored in each tablet insertion groove 112 of the rotor 110. As the rotor 110 rotates, the tablet insertion grooves 112 change positions and each is sequentially brought into line with the dispensing opening 133, such that the tablets in the tablet insertion groove 112 are discharged through the dispensing opening 113. In this state, the tablet stopper 120 closes the open top of the tablet insertion groove 112 placed in a line with the dispensing opening 133, and hence only the tablets contained in the tablet insertion groove 112 in the position can be discharged through the dispensing opening 133.

The case body 130*a* of the case 130 has a stopper insertion hole 134 of a length that allows for the tablet stopper 120 to adjust its height while being inserted in the stopper insertion hole 134. The stopper cover 140 is attached to the case 130 to close the stopper insertion hole 134, and the tablet stopper 120 is mounted on the stopper cover 140 at an adjusted height.

As such, even when the height of the tablet insertion grooves 112 changes as the types of tablets to be contained in the case 130 are changed, the height of the tablet stopper 120 is able to be adjusted within the stopper insertion hole 134 to correspond to the changed height of the tablet insertion grooves 112. The tablet stopper 120 is coupled to the stopper cover at the adjusted height. Therefore, it is possible to flexibly and conveniently deal with the replacement of the rotor 110 for changes in the type of tablet.

Meanwhile, the tablet stopper 120 may include a stopper body 121, first extension ends 122, and second extension ends. The stopper body 121 may have a size large enough to close the top of one tablet insertion groove 112. The first extension ends 122 extend from each side of the stopper body 122 toward the stopper cover 140. The second extension ends 123 are bent inward and extend from the respective first extension ends 122. The first extension ends 122 and the second extension ends 123 may be coupled to form an "L" shape. The tablet stopper 120 may be made of an elastic material, such that the first extension ends 122 can be spread apart by external forces and then restored to their original positions when the external force is removed. For example, the tablet stopper 120 may be made of a material, such as plastic, rubber, and the like, which has elasticity.

The stopper cover 140 may include a cover body 141 and a height adjustment unit 142. The cover body 141 is coupled with the case 130 to close and open the stopper insertion hole 134. The height adjustment unit 142 is formed along an inner surface of the cover body 141, guides the height adjustment of the first and second extension ends 122 and 123, and secures the first and second extension ends 122 and 123.

Figure 5:
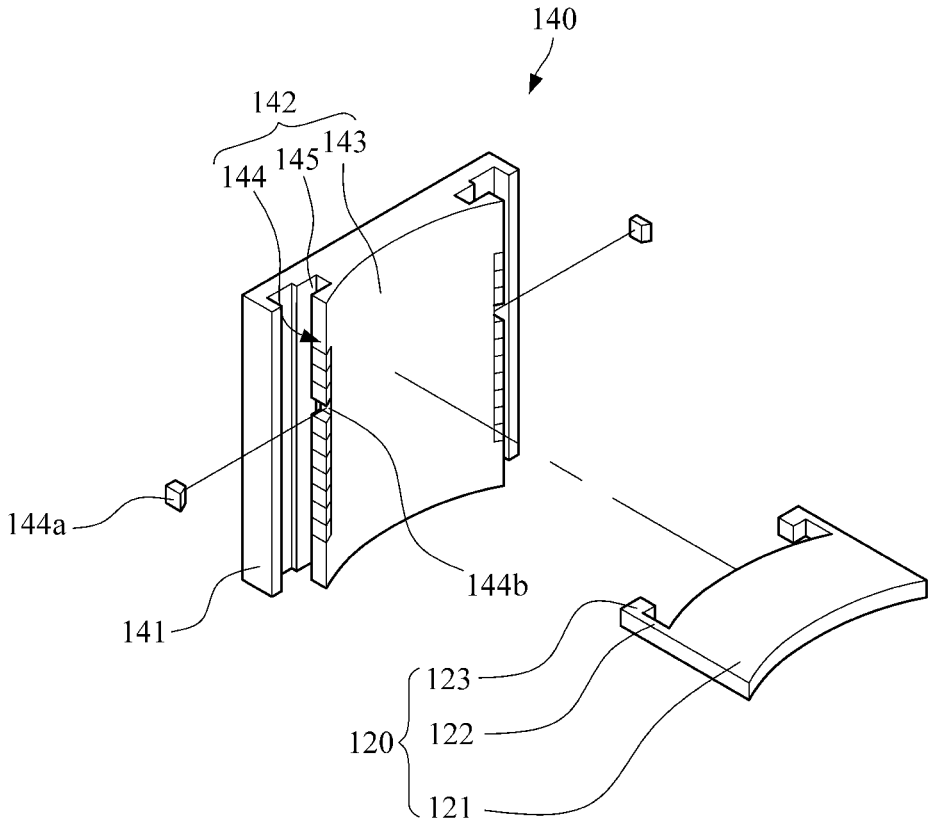
FIG. 5 is a diagram illustrating an exploded perspective view of FIG. 2 to describe procedures of mounting a tablet stopper to a height adjustment unit.
Figure 6:
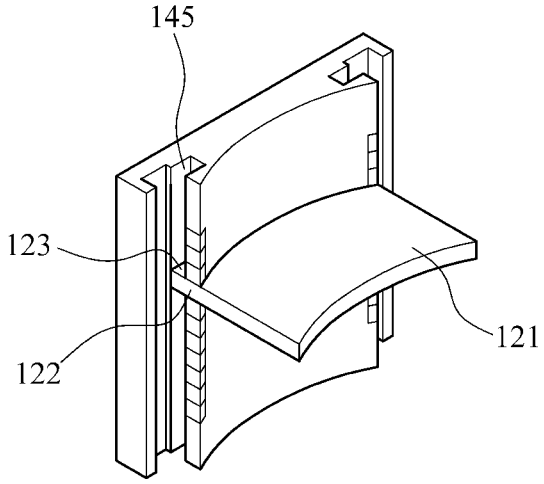
FIG. 6 is a diagram illustrating a perspective view of the tablet stopper mounted on the height adjustment unit of FIG. 5.

For example, as shown in FIGS. 5 and 6, the height adjustment unit 142 may include a mounting block 143, cut portions 144, and rail grooves 145. The mounting block 143 may protrude from the inner surface of the cover body 141.

The cut portions 144 have pieces 143*a* vertically arranged along both sides of the mounting block 143. The pieces 143*a* can be cut away from the cut portions 144. When pieces 144*a* at positions corresponding to an adjusted height of the first extension ends 122 to be coupled to the stopper cover 140 are cut away, securing grooves 144*b* remain at the parts from which the pieces are removed. The first extension ends 122 are inserted and fixed in the respective securing grooves 144*b*. The rail grooves 145 are provided to both sides of the mounting block 143 to guide the movement of the second extension ends 123 inserted therein.

The tablet stopper 120 may be coupled to the stopper cover 140 as follows. The pieces 144*a* at positions corresponding to the height of the first extension ends 122 to be coupled to the stopper cover 140 are cut away from the cut portions 144. The first extension ends 122 are placed at positions corresponding to the securing grooves 144*b*, and the second extension ends 123 are, then, inserted in the respective rail grooves 145 while the first extension ends 122 are spread apart by external force. When the external force applied to the first extension ends 122 is removed, the first extension ends 122 are restored to their original positions, and thereby result in being inserted into the securing grooves 144*b*. As such, the tablet stopper 120 is coupled to the stopper cover 140 at the adjusted height.

Figure 7:
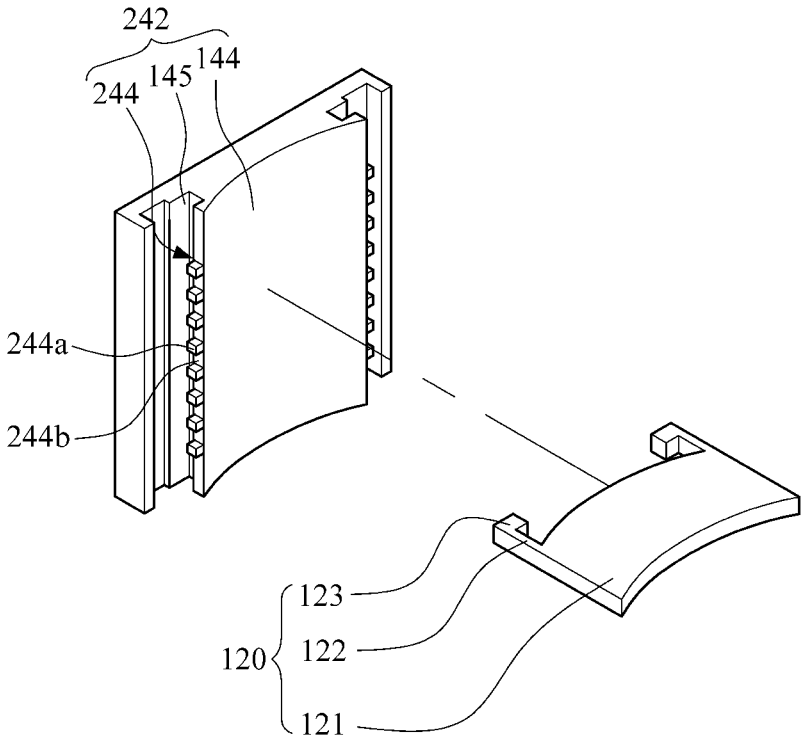
FIG. 7 is a diagram illustrating an exploded perspective view of FIG. 2 to describe procedures of mounting a tablet stopper to another height adjustment unit.

As another example, as shown in FIG. 7, a height adjustment unit 242 may include securing units 244, instead of the cut portions 144. The securing units 244 may include fixing projections 244*a* arranged vertically on both sides of the mounting block 143 at regular intervals from one another. Securing grooves 244*b* may be formed between every two adjacent fixing projections 244*a*. The first extension ends 122 may be inserted and fixed in the securing grooves 244*b* at positions corresponding to an adjusted height of the first extension ends 122. Accordingly, it is possible to mount the tablet stopper 120 to the stopper cover at the adjusted height.

According to the exemplary embodiments of the present invention, when a type of tablets to be accommodated in a case of a tablet cartridge changes and a rotor is replaced by another rotor having tablet insertion grooves with a width and height suitable for the changed tablet, it is possible to adaptably mount the tablet stopper to the case and thereby to flexibly and conveniently deal with the replacement of the rotor.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

A number of exemplary embodiments have been described above. Nevertheless, it will is be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A tablet cartridge for use in a medication dispensing apparatus, the tablet cartridge comprising:

a rotor configured to have a plurality of guide-teeth protruding at regular intervals along a circumference of the rotor, and have tablet insertion grooves formed between the guide-teeth;

a tablet stopper disposed to close a top of one of the tablet insertion grooves;

a case configured to include a container to accommodate the tablets, a rotor housing portion at a lower part of the container to house the rotor, a dispensing opening formed at a position on a lower portion of the rotor housing portion, corresponding to a position of the tablet stopper, and a stopper insertion hole of a length that allows for the tablet stopper to adjust its height while being inserted into the stopper insertion hole; and a stopper cover coupled to the case to close the stopper insertion hole, and have the tablet stopper mounted thereon at an adjusted height, wherein the tablet stopper comprises a stopper body to close the top of one of the tablet insertion grooves, first extension ends extending from each side of the stopper body toward the stopper cover and second extension ends bent inwardly and extending from the respective first extension ends.

2. The tablet cartridge of claim 1, wherein the stopper cover comprises a cover body coupled with the case to close and open the stopper insertion hole and a height adjustment unit formed along an inner surface of the cover body to guide height adjustment of the first and second extension ends and secure the first and second extension ends.

3. The tablet cartridge of claim 2, wherein the height adjustment unit comprises a mounting block protruding from the inner surface of the cover body, cut-portions having pieces vertically arranged along both sides of the mounting block and having the first extension ends inserted and fixed in securing grooves which are formed by removing pieces at positions corresponding to a height of the first extension ends from the respective cut-portions, and rail grooves provided to both sides of the mounting block to guide movement of the second extension ends inserted in the rail grooves.

4. The tablet cartridge of claim 2, wherein the height adjustment unit comprises a mounting block protruding from the inner surface of the cover body, a securing unit having fixing projections arranged vertically on both sides of the mounting block at regular intervals and securing grooves formed between every adjacent two of the fixing projections and having the first extension ends inserted and fixed in the securing grooves at positions responding to an adjusted height of the first extension ends, and rail grooves formed on both sides of the mounting block to guide the movement of the second extension ends while being inserted therein.

* * * * *